US011580999B2

(12) United States Patent
Beack et al.

(10) Patent No.: US 11,580,999 B2
(45) Date of Patent: Feb. 14, 2023

(54) METHOD AND APPARATUS FOR ENCODING AND DECODING AUDIO SIGNAL TO REDUCE QUANTIZATION NOISE

(71) Applicant: Electronics and Telecommunications Research Institute, Daejeon (KR)

(72) Inventors: Seung Kwon Beack, Daejeon (KR); Jongmo Sung, Daejeon (KR); Mi Suk Lee, Daejeon (KR); Tae Jin Lee, Daejeon (KR); Woo-taek Lim, Daejeon (KR); Inseon Jang, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 17/331,416

(22) Filed: May 26, 2021

(65) Prior Publication Data

US 2021/0398547 A1 Dec. 23, 2021

(30) Foreign Application Priority Data

Jun. 23, 2020 (KR) ..... 10-2020-0076467

(51) Int. Cl.

| | |
|---|---|
| ***G10L 19/022*** | (2013.01) |
| ***G10L 19/06*** | (2013.01) |
| ***G10L 19/16*** | (2013.01) |
| ***G10L 19/035*** | (2013.01) |

(52) U.S. Cl.

CPC ..... *G10L 19/035* (2013.01); *G10L 19/022* (2013.01); *G10L 19/06* (2013.01); *G10L 19/167* (2013.01)

(58) Field of Classification Search

CPC ..... G10L 19/022; G10L 19/06; G10L 19/167

See application file for complete search history.

(56) References Cited

U.S. PATENT DOCUMENTS

| | | | | |
|---|---|---|---|---|
| 8,484,038 | B2 | 7/2013 | Bessette et al. | |
| 8,744,843 | B2 | 6/2014 | Geiger et al. | |
| 2011/0257981 | A1* | 10/2011 | Beack | G10L 19/125 704/E21.001 |

(Continued)

OTHER PUBLICATIONS

Max Neuendorf et al., MPEG Unified Speech and Audio Coding—The ISO/MPEG Standard for High-Efficiency Audio Coding of all Content Types, Audio Engineering Society Convention Paper, AES 132nd Convention, Apr. 26-29, 2012, Budapest, Hungary.

*Primary Examiner* — Bryan S Blankenagel

(74) *Attorney, Agent, or Firm* — William Park & Associates Ltd.

(57) ABSTRACT

An audio signal encoding method performed by an encoder includes identifying an audio signal of a time domain in units of a block, generating a combined block by combining i) a current original block of the audio signal and ii) a previous original block chronologically adjacent to the current original block, extracting a first residual signal of a frequency domain from the combined block using linear predictive coding of a time domain, overlapping chronologically adjacent first residual signals among first residual signals converted into a time domain, and quantizing a second residual signal of a time domain extracted from the overlapped first residual signal by converting the second residual signal of the time domain into a frequency domain using linear predictive coding of a frequency domain.

15 Claims, 10 Drawing Sheets

(56) References Cited

U.S. PATENT DOCUMENTS

| | | | | |
|---|---|---|---|---|
| 2012/0209600 | A1 | 8/2012 | Kim et al. | |
| 2013/0132100 | A1 | 5/2013 | Sung et al. | |
| 2019/0341067 | A1* | 11/2019 | Rajendran | G10L 25/30 |
| 2020/0380997 | A1* | 12/2020 | Kumar | G10L 19/167 |

* cited by examiner

METHOD AND APPARATUS FOR ENCODING AND DECODING AUDIO SIGNAL TO REDUCE QUANTIZATION NOISE

CROSS-REFERENCE TO RELATED APPLICATION(S)

This application claims the benefit of Korean Patent Application No. 10-2020-0076467, filed on Jun. 23, 2020, in the Korean Intellectual Property Office, the disclosure of which is incorporated herein by reference.

BACKGROUND

1. Field of the Invention

The present disclosure relates to audio signal encoding and decoding methods to reduce quantization noise and an encoder and a decoder performing the methods and, more particularly, to a technology for generating a residual signal in duplicate to reduce noise generated in a quantization process.

2. Description of the Related Art

Unified speech and audio coding (USAC) is a fourth-generation audio coding technology developed to improve the sound quality of low-bit-rate speech, which was not previously dealt with in the Moving Picture Experts Group (MPEG). The USAC is currently used as the latest audio coding technology that provides high-quality sound for voice and music.

In the USAC or other audio coding technologies, an audio signal is encoded through a quantization process based on linear predictive coding. Linear predictive coding is a technique for encoding an audio signal by encoding a residual signal that is a difference between a current sample and a previous sample in audio samples constituting the audio signal.

However, in a typical coding technology, as the size of the frame increases, the sound quality is greatly distorted due to noise in the quantization process. Accordingly, there is a desire for technology to reduce noise in the quantization process.

SUMMARY

An aspect provides a method of reducing noise occurring in a quantization process by generating residual signals in duplicate when encoding an audio signal, and an encoder and a decoder performing the method.

According to an aspect, there is provided a method of encoding an audio signal in an encoder, the method including identifying an audio signal of a time domain in units of a block, generating a combined block by combining i) a current original block of the audio signal and ii) a previous original block chronologically adjacent to the current original block, extracting a first residual signal of a frequency domain from the combined block using linear predictive coding of a time domain, overlapping first residual signals chronologically adjacent to each other among first residual signals converted into a time domain, quantizing a second residual signal of a time domain extracted from the overlapped first residual signal by converting the second residual signal of the time domain into a frequency domain using linear predictive coding of a frequency domain, and encoding a quantized linear predictive coefficient of a time domain, a quantized linear predictive coefficient of a frequency domain, and the quantized second residual signal into a bitstream.

The method may further include quantizing a linear predictive coefficient of a time domain extracted from the combined block of the audio signal and generating a frequency envelope by inversely quantizing the linear predictive coefficient of the time domain.

The extracting of the first residual signal may generate a first residual signal from the combined block converted into a frequency domain based on the frequency envelope. The encoding into the bitstream may additionally encode the quantized linear predictive coefficient of the time domain into a bitstream.

The method may further include quantizing a linear predictive coefficient of a frequency domain extracted from the overlapped first residual signal using linear predictive coding of a frequency domain, generating a time envelope by inversely quantizing the linear predictive coefficient of the frequency domain, and extracting a second residual signal of a time domain from the overlapped first residual signal based on the time envelope. The encoding into the bitstream may additionally encode the quantized linear predictive coefficient of the frequency domain into a bitstream.

The quantizing of the linear predictive coefficient of the frequency domain may include performing Hilbert-transformation on the overlapped first residual signal, converting the Hilbert-transformed first residual signal and the overlapped residual signal into a frequency domain, extracting a linear predictive coefficient of a frequency domain corresponding to the Hilbert-transformed first residual signal and the overlapped first residual signal using linear predictive coding, and quantizing the linear predictive coefficient of the frequency domain.

The extracting of the second residual signal may include generating a current envelope interpolated from a time envelope using symmetric windowing and extracting a second residual signal of a time domain from the overlapped first residual signal based on the current envelope.

The first residual signal may correspond to two original blocks chronologically adjacent to each other. The overlapping of the first residual signal may overlap two first residual signals corresponding to an original block belonging to a predetermined time among first residual signals adjacent chronologically.

The generating of the frequency envelope may include converting the inversely quantized linear predictive coefficient of the time domain into a frequency domain, grouping the converted linear predictive coefficient of the time domain for each sub-band, and generating a frequency envelope corresponding to the combined block by calculating energy of the grouped linear predictive coefficients of the time domain.

The quantizing of the second residual signal may include grouping the second residual signal for each sub-band and determining a scale factor for quantization for each of the grouped residual signal and quantizing the second residual signal using the scale factor.

The determining of the scale factor may determine the scale factor based on an intermediate value of a frequency envelope corresponding to the second residual signal or determine the scale factor based on a number of bits available for quantization of the second residual signal.

According to another aspect, there is also provided a method of decoding an audio signal in a decoder, the method including extracting a quantized linear predictive coefficient of a time domain, a quantized linear predictive coefficient of a frequency domain, and a quantized second residual signal of a frequency domain from a bitstream received from an encoder, generating a first residual signal of a time domain from the second residual signal converted into a time domain based on a time envelope generated by inversely quantizing the linear predictive coefficient of the time domain, and restoring a combined block of an audio signal from the first residual signal converted into the frequency domain based on a frequency envelope generated by inversely quantizing the linear predictive coefficient of the frequency domain.

The method may further include generating a restored block by overlapping original blocks corresponding to a same point in time among original blocks included in the restored combined blocks adjacent chronologically.

The generating of the first residual signal may include generating a current envelope interpolated from a time envelope using symmetric windowing, converting the second residual signal into a time domain by inversely quantizing the second residual signal, and generating the first residual signal from the converted second residual signal using the current envelope.

According to another aspect, there is also provided an encoder for performing a method of encoding an audio signal, the encoder including a processor, wherein the processor is configured to identify an audio signal of a time domain in units of a block, generate a combined block by combining i) a current original block of the audio signal and ii) a previous original block chronologically adjacent to the current original block, extract a first residual signal of a frequency domain from the combined block using linear predictive coding of a time domain, overlap first residual signals chronologically adjacent to each other among first residual signals converted into a time domain, quantize a second residual signal of a time domain extracted from the overlapped first residual signal by converting the second residual signal of the time domain into a frequency domain using linear predictive coding of a frequency domain, and encode a quantized linear predictive coefficient of a time domain, a quantized linear predictive coefficient of a frequency domain, and the quantized second residual signal into a bitstream.

The processor may be configured to quantize a linear predictive coefficient of a time domain extracted from the combined block of the audio signal, generate a frequency envelope by inversely quantizing the linear predictive coefficient of the time domain, generate a first residual signal from the combined block converted into a frequency domain based on the frequency envelope, and additionally encode the quantized linear predictive coefficient of the time domain into a bitstream.

The processor may be configured to quantize a linear predictive coefficient of a frequency domain extracted from the overlapped first residual signal using linear predictive coding of a frequency domain, generate a time envelope by inversely quantizing the linear predictive coefficient of the frequency domain, extract a second residual signal of a time domain from the overlapped first residual signal based on the time envelope, and additionally encode the quantized linear predictive coefficient of the frequency domain into a bitstream.

The processor may be configured to perform Hilbert-transformation on the overlapped first residual signal, convert the Hilbert-transformed first residual signal and the overlapped residual signal into a frequency domain, extract a linear predictive coefficient of a frequency domain corresponding to the Hilbert-transformed first residual signal and the overlapped first residual signal using linear predictive coding, and quantize the linear predictive coefficient of the frequency domain.

The processor may be configured to generate a current envelope interpolated from a time envelope using symmetric windowing and extract a second residual signal of a time domain from the overlapped first residual signal based on the current envelope.

The first residual signal may correspond to two original blocks chronologically adjacent to each other. The processor may overlap two first residual signals corresponding to an original block belonging to a predetermined time among first residual signals adjacent chronologically.

The processor may be configured to convert the inversely quantized linear predictive coefficient of the time domain into a frequency domain, group the converted linear predictive coefficient of the time domain for each sub-band, and generate a frequency envelope corresponding to the combined block by calculating energy of the grouped linear predictive coefficients of the time domain.

The processor may be configured to group the second residual signal for each sub-band and determining a scale factor for quantization for each of the grouped residual signal and quantize the second residual signal using the scale factor.

The processor may be configured to determine the scale factor based on an intermediate value of a frequency envelope corresponding to the second residual signal or determine the scale factor based on a number of bits available for quantization of the second residual signal.

According to another aspect, there is also provided a decoder performing a method of decoding an audio signal, the decoder includes a processor, wherein the processor is configured to extract a quantized linear predictive coefficient of a time domain, a quantized linear predictive coefficient of a frequency domain, and a quantized second residual signal of a frequency domain from a bitstream received from an encoder, generate a first residual signal of a time domain from the second residual signal converted into a time domain based on a time envelope generated by inversely quantizing the linear predictive coefficient of the time domain, and restore a combined block of an audio signal from the first residual signal converted into the frequency domain based on a frequency envelope generated by inversely quantizing the linear predictive coefficient of the frequency domain.

The processor may be configured to generate a restored block by overlapping original blocks corresponding to a same point in time among original blocks included in the restored combined blocks adjacent chronologically.

The processor may be configured to generate a current envelope interpolated from a time envelope using symmetric windowing, convert the second residual signal into a time domain by inversely quantizing the second residual signal, and generate the first residual signal from the converted second residual signal using the current envelope.

According to example embodiments, it is possible to reduce noise occurring in a quantization process by generating residual signals in duplicate when encoding an audio signal.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION

Figure 1:
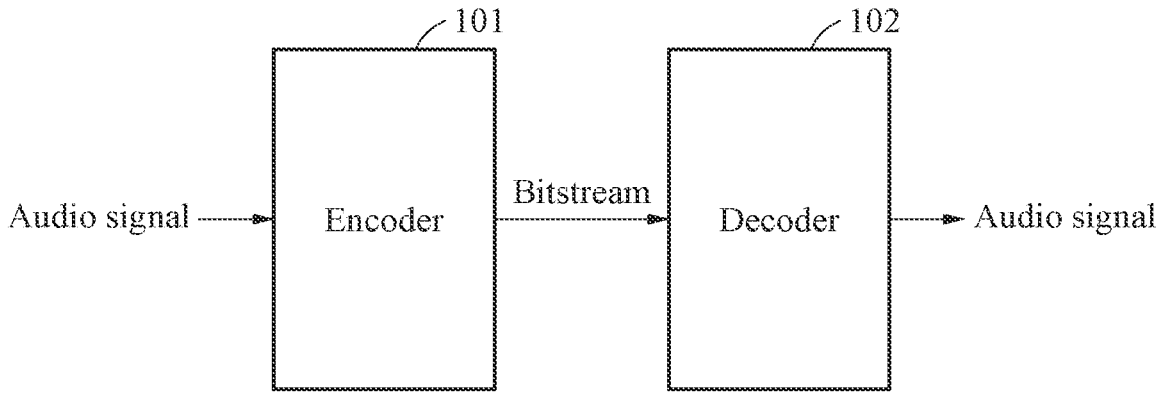
FIG. 1 is a diagram illustrating an encoder and a decoder according to an example embodiment of the present disclosure.

Hereinafter, example embodiments will be described in detail with reference to the accompanying drawings. It should be understood, however, that there is no intent to limit this disclosure to the particular example embodiments disclosed. On the contrary, example embodiments are to cover all modifications, equivalents, and alternatives falling within the scope of the example embodiments.

The terminology used herein is for the purpose of describing particular embodiments only and is not intended to be limiting. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms, including technical and scientific terms, used herein have the same meaning as commonly understood by one of ordinary skill in the art to which this disclosure pertains. Terms, such as those defined in commonly used dictionaries, are to be interpreted as having a meaning that is consistent with their meaning in the context of the relevant art, and are not to be interpreted in an idealized or overly formal sense unless expressly so defined herein.

Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

FIG. 1 is a diagram illustrating an encoder and a decoder according to an example embodiment of the present disclosure.

To reduce the present disclosure encodes of an audio signal by performing linear predictive coding to reduce sound quality distortion and quantizing a residual signal double extracted from the audio signal.

Specifically, the present disclosure generates a residual signal of a frequency domain based on a frequency envelope generated using linear predictive coding of a time domain and generates a new residual signal from the generated residual signal using linear prediction coding of the frequency domain. As such, the audio signal may be encoded by extracting the residual signals in duplicate.

An envelope may refer to a curve having a shape surrounding a waveform of a residual signal. A frequency envelope represents a rough outline of a residual signal of a frequency domain. A time envelope represents a rough outline of a residual signal of a time domain.

In addition, the present disclosure may estimate a multiband quantization scale factor in a process of quantizing a residual signal and efficiently perform quantization of the residual signal using the estimated scale factor.

An encoder 101 and a decoder 102 respectively performing an encoding method and a decoding method of the present disclosure may each correspond to a processor. The encoder 101 and the decoder 102 may correspond to the same processor or different processors.

Referring to FIG. 1, the encoder 101 processes and converts an audio signal into a bitstream and transmits the bitstream to the decoder 102. The decoder 102 may restore the audio signal using the received bitstream.

The encoder 101 and the decoder 102 may process the audio signal in units of a block. The audio signal may include audio samples of the time domain. Also, an original block of the audio signal may include a plurality of audio samples belonging to a predetermined time section. The audio signal may include a plurality of successive original blocks. Also, the original block of the audio signal may correspond to a frame of the audio signal.

In the present disclosure, chronologically adjacent original blocks may be combined and encoded into a combined block. For example, the combined block may include two original blocks chronologically adjacent to each other. When a combined block corresponding to a predetermined point in time includes a current original block and a previous original block, a combined block corresponding to a point in time next to the predetermined point in time may include the current original block of the predetermined point in time as a previous original block.

A process of encoding the generated combined block will be described in greater detail with reference to FIG. 2.

Figure 2:
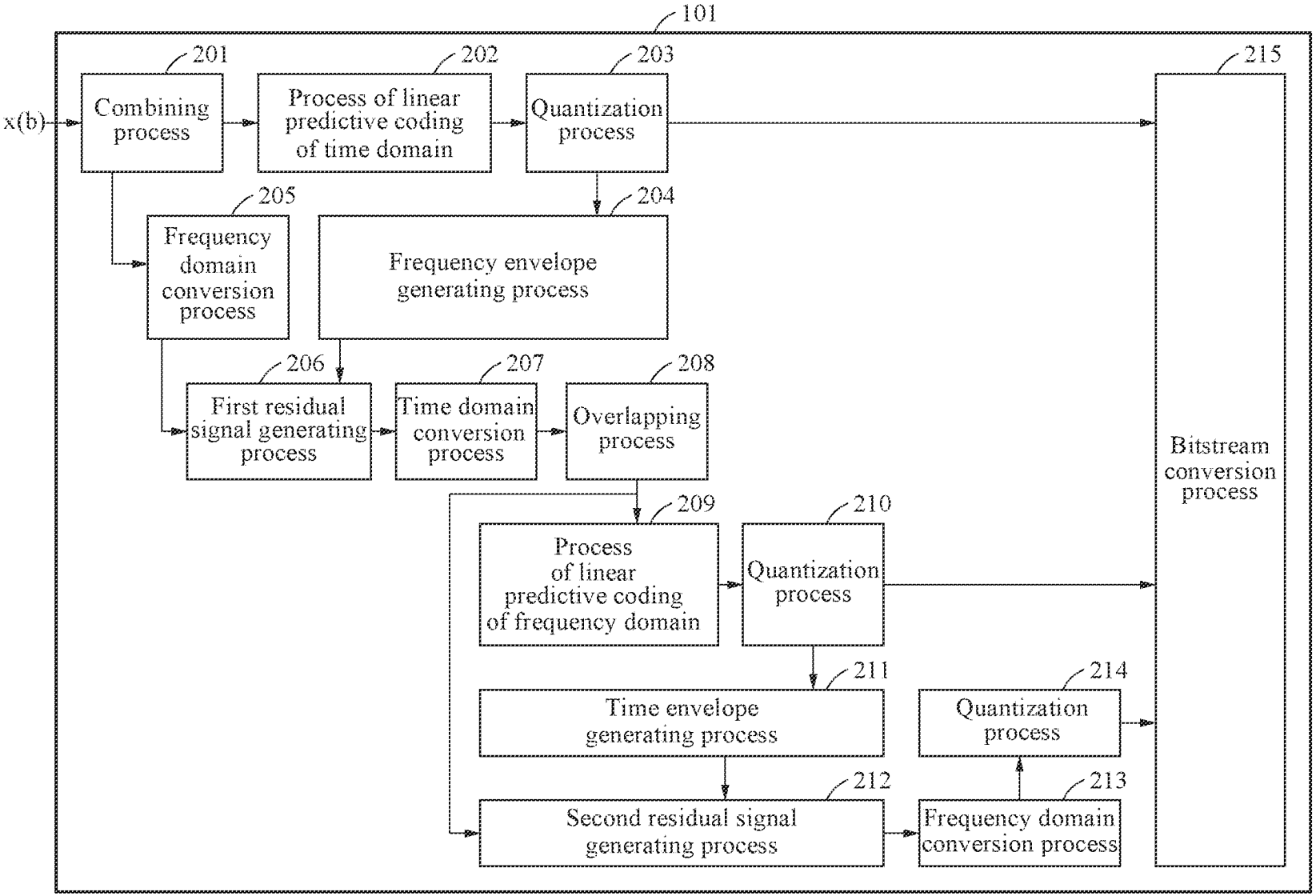
FIG. 2 is a diagram illustrating an operation of an encoder according to an example embodiment of the present disclosure.

FIG. 2 is a diagram illustrating an operation of an encoder according to an example embodiment of the present disclosure.

Referring to FIG. 2, x(b) denotes an original block of an audio signal, b denotes an index of the original block. For example, the index of the original block may be determined to increase with time, x(b) includes N audio samples. In a combining process 201, the encoder 101 generates a combined block by combining chronologically adjacent original blocks.

Specifically, if x(b) is a current original block, x(b−1) is a previous original block. In the combining process 201, the encoder 101 generates a combined block by combining the current original block and the previous original block. The current original block and the previous original block are chronologically adjacent to each other. The current original block refers to an original block of a predetermined point in time. The combined block, for example, X(b) may be represented by Equation 1.

$$X(b)=[x(b-1),x(b)]^T \quad \text{[Equation 1]}$$

The combined block is generated at intervals of one original block. For example, a b-th combined block X(b) includes a b-th original block x(b) and a (b−1)-th original block x(b−1). Likewise, a (b−1)-th combined block X(b−1) includes the (b−1)-th original block x(b−1) and a (b−2)-th original block x(b−2). When generating a combined block, if chronologically successive audio signals are input, the encoder 101 uses a buffer to use a current original block of a combined block of a predetermined point in time as a previous original block of a next point in time.

Also, in a process 202 of linear predictive coding of a time domain, the encoder 101 extracts a linear predictive coefficient of the time domain from the combined block using the linear predictive coding of the time domain.

Specifically, the encoder 101 generates a linear predictive coefficient of the time domain from the combined block using Equation 2 below. A process of calculating the linear predictive coefficient is not limited to the example described herein.

$$err(n)=x(n)+\Sigma_{p=0}^{P} lpc_{td}(p)x(n-p) \quad \text{[Equation 2]}$$

In Equation 2, $lpc_{td}(\ )$ denotes a linear predictive coefficient of a time domain corresponding to a combined block. The encoder 101 may determine a linear predictive coefficient [$lpc_{td}(b)$, $lpc_{td}(b-1)$] of a time domain from a combined block using Equation 2, p denotes a number of linear predictive coefficients.

Also, the linear predictive coefficient of the time domain may be quantized through a quantization process 203, converted into a bitstream in a bitstream conversion process 215, and then transmitted to a decoder. A method of quantizing the linear predictive coefficient of the time domain is not limited to a specific method, and various methods may apply.

In a frequency envelope generating process 204, the encoder 101 inversely quantizes the quantized linear predictive coefficient of the time domain and uses the inversely quantized linear predictive coefficient to generate a frequency envelope. Specifically, the encoder 101 converts the linear predictive coefficient of the time domain into a frequency domain. For example, the encoder 101 performs 2N-point discrete Fourier transformation (DFT), thereby converting the linear predictive coefficient of the time domain into the frequency domain.

Specifically, the linear predictive coefficient of the time domain is converted into the frequency domain according to Equation 3.

$$lpc_{td,f}(b)=\mathrm{Cut}_N\{DFT_{2N}\{lpc_{td}(b)\}\} \quad \text{[Equation 3]}$$

In Equation 3, $lpc_{td,f}(b)$ denotes a linear predictive coefficient corresponding to a b-th combined block among linear predictive coefficients of the time domain converted into the frequency domain and $\mathrm{Cut}_N$ denotes a function of cutting out a portion corresponding to N points. $DFT_{2N}(\ )$ denotes a function of conversion based on 2N-point DFT. $lpc_{td}(b)$ denotes a linear predictive coefficient corresponding to a b-th original block among linear predictive coefficients of the time domain. Since a result obtained through the 2N-point DFT is symmetric, the encoder 101 cuts out a portion corresponding to N points from the result of 2N-point DFT.

Also, the encoder 101 calculates an absolute value of the linear predictive coefficient of the time domain converted into the frequency domain and determines a frequency envelope for each sub-band. Specifically, the encoder 101 may generate the frequency envelope by determining a value for each sub-band of the frequency envelope according to Equation 4.

$$env_{fd}(k) = \frac{1}{A(k+1)-A(k)+1} \times 10 \times \log 10\left[\sum_{kk=A(k)}^{kk=A(k+1)} \mathrm{abs}\left(s_lpc_{td,f}(kk)\right)^2\right] 0 \le k \le K-1 \quad \text{[Equation 4]}$$

In Equation 4, $env_{fd}(k)$ denotes a value of a frequency envelope corresponding to a k-th sub-band. AO denotes an index of an audio sample corresponding to a boundary of sub-bands. For example, A(k) denotes an audio sample corresponding to the k-th sub-band, and A(k+1)-A(k)+1 denotes a number of audio samples corresponding to the k-th sub-band. kk denotes an index of a sub-band belonging to a section of the k-th sub-band. abs( ) is a function for calculating an absolute value. K denotes a number of sub-bands.

The encoder 101 may determine the frequency envelope for each sub-band by calculating an average of absolute values of the linear predictive coefficient of the time domain converted into the frequency domain for each sub-band.

$s_lpc_{td,f}(\ )$ is a linear predictive coefficient processed by smoothing the linear predictive coefficient of the time domain converted into the frequency domain. For example, the smoothing processing may be performed according to Equation 5.

$$s_lpc_{td,f}(kk)=(1-\alpha)\times lpc_{td,f}(kk,b)+(\alpha)\times lpc_{td,f}(kk,b-1) \quad \text{[Equation 5]}$$

In Equation 5, b denotes an index of the current original block. kk denotes an index of a sub-band belonging to a section of the k-th sub-band. $lpc_{td,f}(kk, b)$ corresponds to a specific sub-band belonging to the section of the k-th sub-band and represents a linear predictive coefficient corresponding to a b-th original block among the linear predictive coefficients of the time domain converted into the frequency domain. α may be determined as a value ranging between 1 and 0.

For example, the smoothing processing may be performed by linearly interpolating i) the linear predictive coefficient of the time domain converted into the frequency domain corresponding to the current original block and ii) the linear predictive coefficient of the time domain converted into the frequency domain corresponding to the previous original block.

For example, if α is 0.5, the smoothing may be performed at a same ratio. Also, if α is 0, only the linear predictive coefficient of the time domain corresponding to the current original block may be used. The smoothing processing is for reducing a distortion of a signal occurring due to aliasing in a process of converting into the frequency domain such as modified discrete cosine transformation (MDCT).

In a first residual signal generating process 206, the encoder 101 may generate a first residual signal of the frequency domain from the combined block converted into the frequency domain based on the frequency envelope. A frequency domain conversion process 205 is performed in advance.

In the frequency domain conversion process 205, the encoder 101 converts the combined block of the time domain into the frequency domain. For example, the MDCT or DFT may be used for the conversion into the frequency domain.

In the first residual signal generating process 206, the encoder 101 may extract the first residual signal from the combined block of the frequency domain using the frequency envelope according to Equations 6 through 8.

$$\mathrm{abs}(res_{tdlp,f}(A(k):A(k+1)))=10\log 10(\mathrm{abs}(X_f[A(k):A(k+1)])^2-env_{fd}(k),0\le k\le K-1 \quad \text{[Equation 6]}$$

$$\mathrm{angle}(res_{tdlp,f}(A(k):A(k+1)))=\mathrm{angle}(X_f[A(k):A(k+1)]),\ 0\le k\le K-1 \quad \text{[Equation 7]}$$

$$res_{tdlp,f}(A(k):A(k+1))=\mathrm{abs}(res_{tdlp,f}(A(k):A(k+1)))\exp(j\times\mathrm{angle}(res_{tdlp,f}(A(k):A(k+1)))) \quad \text{[Equation 8]}$$

In Equation 6, A(k) denotes an index of audio samples of an original block corresponding to the k-th sub-band. Also, the encoder 101 determines an absolute value of an audio signal $X_f$[A(k):A(k+1)] corresponding to the k-th sub-band in the combined block converted into the frequency domain. The encoder 101 may calculate a difference between the determined absolute value and a frequency envelope $env_{fd}$(k) corresponding to the k-th sub-band, thereby obtaining an absolute value of a first residual signal $res_{tdlp,f}$(A(k):A(k+1)) of the frequency domain corresponding to the k-th sub-band.

In Equation 7, angle( ) denotes an angle function, which is a function of returning a phase angle for an input value. The encoder 101 may calculate a phase angle of the first residual signal $res_{tdlp,f}$(A(k):A(k+1)) corresponding to the k-th sub-band from a phase angle of the combined block (e.g., $X_f$[A(k):A(k+1)]) corresponding to the k-th sub-band.

The encoder 101 may acquire the first residual signal from the absolute value of the first residual signal and the phase angle of the first residual signal calculated according to Equation 8. Specifically, the encoder 101 may determine the first residual signal by multiplying an output value of an exponential function (exp( )) for the phase angle of the first residual signal corresponding to the k-th sub-band by the absolute value of the first residual signal corresponding to the k-th sub-band. j is a variable for representing a complex number.

S In a time domain conversion process 207, the encoder 101 may convert the first residual signal $res_{tdlp,f}$(A(k):A(k+1)) into the time domain. For example, through Inverse-MDCT (IMDCT), the encoder 101 may convert the first residual signal $res_{tdlp,f}$(A(k):A(k+1) of the frequency domain into a first residual signal $res_{tdlp}$(A(k):A(k+1) of the time domain.

In an overlapping process 208, the encoder 101 overlaps first residual signals adjacent chronologically among the first residual signals converted into the time domain. In order to eliminate the aliasing of the time domain, the encoder 101 may combine the chronologically adjacent first residual signals using an overlap-add operation.

Specifically, the first residual signal corresponds to a combined block including two original blocks. A current original block of a combined block of a specific point in time may be an original block corresponding to the same point in time as a previous original block of a combined block of a next point in time. Thus, one of two original blocks of the adjacent first residual signals may correspond to the same point in time. The encoder 101 overlaps two first residual signals corresponding to an original block belonging to a predetermined time among the chronologically adjacent first residual signals.

For example, the encoder 101 may combine first residual signals corresponding to original blocks x(b−1) and x(b) with first residual signals corresponding to x(b−2) and x(b−1) and combine first residual signals corresponding to x(b−2) and x(b−1) with first residual signals corresponding to x(b−3) and x(b−2), thereby generating first residual signals corresponding to x(b−1) and x(b−2) overlapping between the first residual signals. As such, the encoder 101 may acquire the overlapped first residual signal by delay-processing the two original blocks. A related description will be given with reference to FIG. 4.

In a process 209 of linear predictive coding of a frequency domain, the encoder 101 extracts a linear predictive coefficient of the frequency domain from the overlapped first residual signal using linear predictive coding of the frequency domain.

Specifically, the encoder 101 convert the overlapped first residual signal and a Hilbert-transformed overlapped first residual signal into the frequency domain. In addition, the encoder 101 extracts linear predictive coefficients of the time domain corresponding to the overlapped first residual signal and a Hilbert-transformed overlapped first residual signal using the linear predictive coding.

A detailed process of the linear predictive coding of the frequency domain will be described with reference to FIG. 5.

In a quantization process 210, the encoder 101 quantizes the linear predictive coefficient of the frequency domain. The encoder 101 converts the quantized linear predictive coefficient of the frequency domain into a bitstream in a bitstream conversion process 215 and transmits a conversion result to a decoder. A method of quantizing the linear predictive coefficient of the frequency domain is not limited to a specific method and various methods may apply thereto.

In a time envelope generating process 211, the encoder 101 inversely quantizes the quantized linear predictive coefficient of the frequency domain and uses the inversely quantized linear predictive coefficient to generate a time envelope. Specifically, according to Equation 9, the encoder 101 inversely quantizes the quantized linear predictive coefficient, converts the linear predictive coefficient of the frequency domain into the time domain, and generates the time envelope based on the linear predictive coefficient of the frequency domain converted into the time domain.

$$env_{td}(b)=\frac{1}{N}\times 10\times\log 10\left[\mathrm{abs}\left(IDFT\left\{lpc_{fdlp,c}(b),\ 2N\right\}\right)^2\right] \quad \text{[Equation 9]}$$

In Equation 9, $env_{td}$(b) denotes a value of a time envelope corresponding to a b-th combined block in the time envelope for the combined block. abs( ) is a function of outputting an absolute value for an input value. $lpc_{fdlp,c}$(b) denotes a value of a complex number of the linear predictive coefficient corresponding to the b-th combined block among the linear predictive coefficients of the frequency domain. IDFT{$lpc_{fdlp,c}$(b), 2N} is a function of outputting a result of 2N-point inverse-DFT (IDFT) performed on $lpc_{fdlp,c}$(b). N denotes a number of audio samples included in an original block.

In a second residual signal generating process 212, the encoder 101 extracts a second residual signal of the time domain from the overlapped first residual signal based on the time envelope. To extract the second residual signal, the encoder 101 may use symmetric windowing to generate a current envelope interpolated from the time envelope.

A detailed process of generating the current envelope will be described with reference to FIG. 6. Also, the encoder 101 extracts the second residual signal of the time domain from the overlapped first residual signal using the current envelope according to Equations 10 through 12.

$$\mathrm{abs}(\mathrm{pres}_{fdlp}(b))=10\log 10(\mathrm{abs}(\mathrm{pres}_{tdlp}(b))^2)-cur_en(b) \quad \text{[Equation 10]}$$

$$\mathrm{angle}(\mathrm{pres}_{fdlp}(b))=\mathrm{angle}(\mathrm{pres}_{tdlp}(b)) \quad \text{[Equation 11]}$$

$$\mathrm{pres}_{fdlp}(b)=\mathrm{abs}(\mathrm{pres}_{fdlp}(b))\exp(j\times\mathrm{angle}(\mathrm{pres}_{fdlp}(b))) \quad \text{[Equation 12]}$$

In Equation 10, b denotes an index of the current original block. cur_en(b) denotes a current envelope corresponding to the current original block. $\mathrm{pres}_{tdlp}$(b) denotes the first residual signal corresponding to the b-th original block in the overlapped first residual signal $\mathrm{pres}_{fdlp}$(b) denotes a second residual signal corresponding to the b-th original block in the second residual signal of the time domain. The encoder 101 determines an absolute value of the overlapped first residual signal. The encoder 101 may calculate a difference between the determined absolute value and the current envelope, thereby acquiring an absolute value of the second residual signal of the time domain.

In Equation 11, angle( ) denotes an angle function, which is a function of returning a phase angle for an input value. The encoder 101 may calculate a phase angle of the second residual signal from a phase angle of the overlapped first residual signal.

The encoder 101 may determine a second residual signal based on the absolute value of the second residual signal and the phase angle of the second residual signal calculated to according to Equation 12. Specifically, the encoder 101 may determine a second residual signal by multiplying an output value of an exponential function exp( ) for the phase angle of the second residual signal by the absolute value of the second residual value. j is a variable for representing a complex number.

In addition, the second residual signal may correspond to the combined block and thus, correspond to two original blocks chronologically adjacent to each other. For example, a quantized second residual signal [$\mathrm{pres}_{fdlp}$(b−1), $\mathrm{pres}_{fdlp}$(b)]$^T$ may be composed of a second residual signal $\mathrm{pres}_{fdlp}$(b−1) corresponding to the (b−1)-th original block and a second residual signal $\mathrm{pres}_{fdlp}$(b) corresponding to the b-th original block. Through this, a difference in quantization noise occurring between original blocks may be reduced, which may lead to a decrease in sound-quality distortion.

In a frequency domain conversion process 213, the encoder 101 may convert the second residual signal of the time domain into the frequency domain. For example, the encoder 101 may convert the second residual signal into the frequency domain through the 2N-point DFT. The converted second residual signal of the frequency domain is quantized through a quantization process 214, converted into a bitstream, and transmitted to the decoder.

In the quantization process 214, the encoder 101 quantizes the second residual signal. Specifically, the encoder 101 groups second residual signals for each sub-band and determines a scale factor for each group of the second residual signals. The encoder 101 quantizes the second residual signal using the determined scale factor.

The encoder 101 subtracts, from a residual signal, the scale factor determined for each sub-band based on the number of bits to be used for quantization in a process of quantizing the residual signal, thereby improving a quantization efficiency. The scale factor is determined for each sub-band and is used to reduce a frequency component of the residual signal in consideration of the number of bits to be used for quantization in the process of quantizing the residual signal. A method of determining the scale factor will be described in greater detail with reference to FIG. 4.

As described with reference to FIG. 2, the encoder 101 converts or encodes i) the quantized linear predictive coefficient of the time domain generated from the original block of the audio signal, ii) the quantized linear predictive coefficient of the frequency domain, and iii) the quantized second residual signal of the frequency domain into the bitstream and transmits a result of the conversion or encoding to the decoder.

Figure 3:
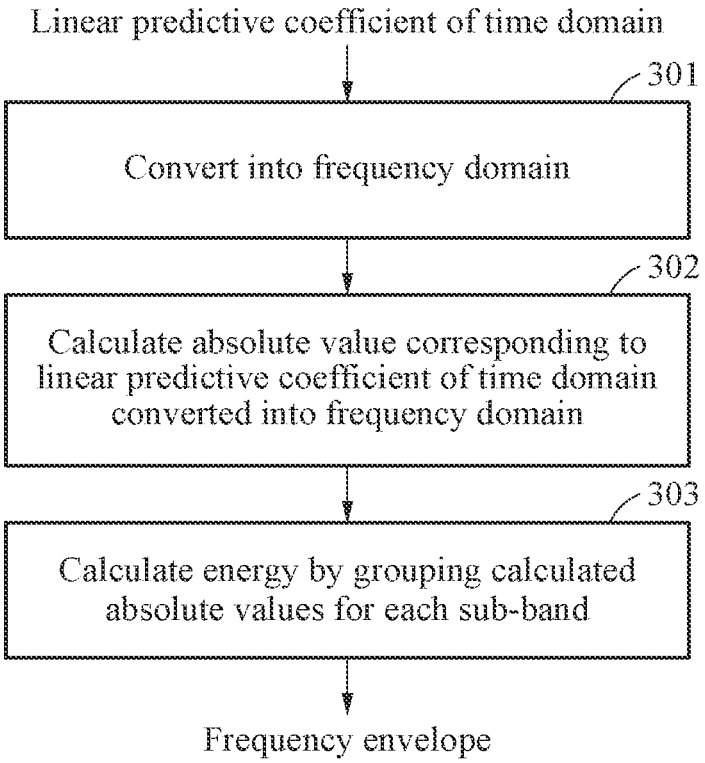
FIG. 3 is a flowchart illustrating a process of generating a frequency envelope using a linear predictive coefficient according to an example embodiment of the present disclosure.

FIG. 3 is a flowchart illustrating a process of generating a frequency envelope using a linear predictive coefficient according to an example embodiment of the present disclosure.

In a frequency envelope generating process, an encoder inversely quantizes a quantized linear predictive coefficient of a time domain and uses the inversely quantized linear predictive coefficient to generate a frequency envelope. In operation 301, the encoder converts the linear predictive coefficient of the time domain into a frequency domain. For example, the encoder performs 2N-point DFT, thereby converting the linear predictive coefficient of the time domain into the frequency domain.

In operation 302, the encoder calculates an absolute value of the linear predictive coefficient of the time domain converted into the frequency domain. Also, the encoder determines a frequency envelope for each sub-band.

In operation 302, when using the linear predictive coefficient of the time domain converted into the frequency domain, the encoder may calculate the absolute value after smoothing processing of the linear predictive coefficient of the time domain converted into the frequency domain.

Specifically, the smoothing processing may be performed by linearly interpolating i) the linear predictive coefficient of the time domain converted into the frequency domain corresponding to the current original block and ii) the linear predictive coefficient of the time domain converted into the frequency domain corresponding to the previous original block. The smoothing process is for reducing a distortion of a signal occurring due to aliasing in a process of converting into the frequency domain such as MDCT.

In operation 303, the encoder may generate a frequency envelope by determining a value for each sub-band of the frequency envelope according to Equation 4. Specifically, the encoder may determine the frequency envelope for each sub-band by calculating an average of absolute values of the linear predictive coefficient of the time domain converted into the frequency domain for each sub-band.

Figure 4:
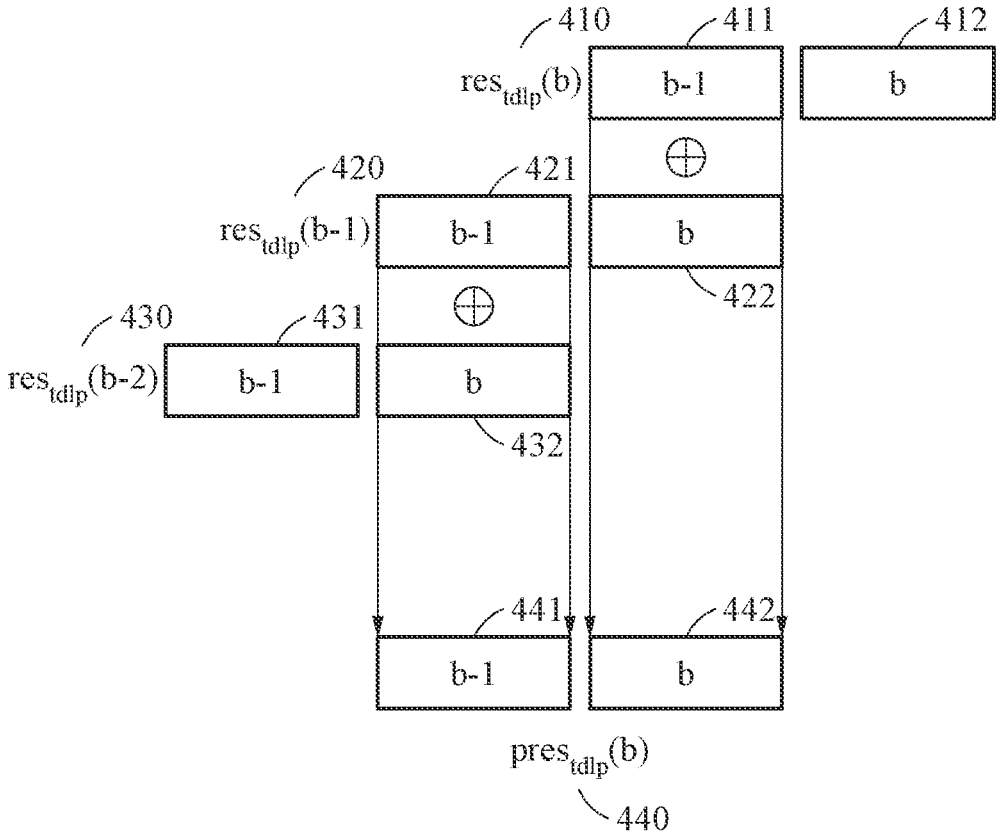
FIG. 4 is a diagram illustrating a process of combining residual signals according to an example embodiment of the present disclosure.

FIG. 4 is a diagram illustrating a process of combining residual signals according to an example embodiment of the present disclosure.

A first residual signal corresponds to a combined block including two original blocks. A current original block of a combined block of a specific point in time may be an original block corresponding to the same point in time as a previous original block of a combined block of a next point in time. Thus, one of two original blocks of the adjacent first residual signals may correspond to the same point in time.

Referring to FIG. 4, first residual signals 410, 420, and 430 adjacent chronologically may each be a residual signal corresponding to two original blocks. A current original block 432 of the first residual signal 430 corresponds to a previous original block 421 of the first residual signal 420 chronologically adjacent to the first residual signal 430. As shown in FIG. 4, the combined block also includes two original blocks, but is generated at an interval of one original block. Also, adjacent combined blocks include original blocks corresponding to the same time section.

Accordingly, when there is an original block belonging to a specific time, two combined blocks including the original block belonging to the specific time may be generated and the first residual signal corresponding to the combined block may be generated. Referring to FIG. 4, the encoder overlaps two first residual signals corresponding to the original block belonging to the specific time among the chronologically adjacent first residual signals.

Also, referring to FIG. 4, an overlapped first residual signal 440 is a residual signal with a length corresponding to two original blocks 441 and 442. To generate the overlapped first residual signal 440, the encoder may store the first residual signals 430 and 420 corresponding to two or more original blocks in a buffer. Thus, delay processing occurs for a length of time corresponding to the two original blocks.

An overlap operation refers to, for example, an overlap-add operation, which is performed to obtain a residual signal of a complete time domain and used to eliminate time domain aliasing (TDA) occurring in an MDCT/IMDCT process.

Figure 5:
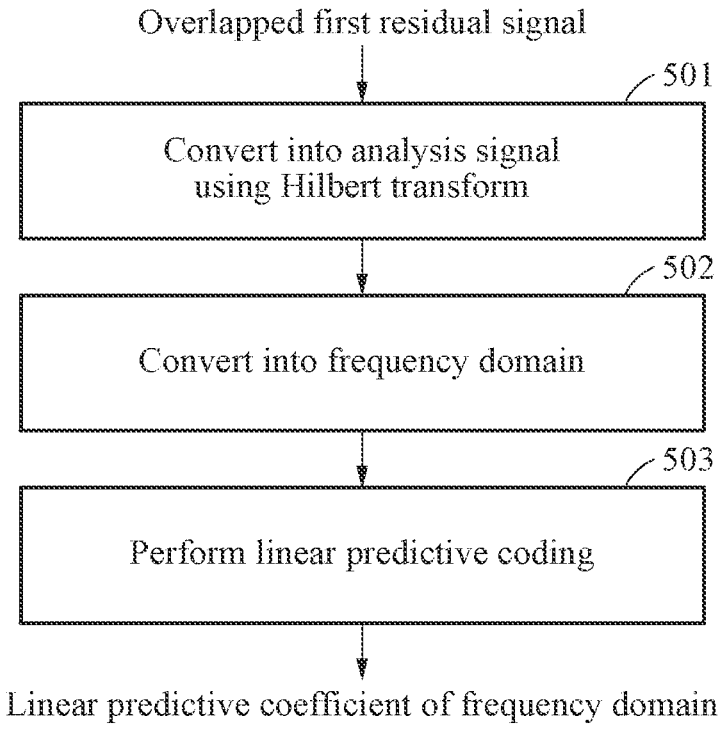
FIG. 5 is a flowchart illustrating a process of linear predictive coding of a frequency domain according to an example embodiment of the present disclosure.

FIG. 5 is a flowchart illustrating a process of linear predictive coding of a frequency domain according to an example embodiment of the present disclosure.

In operation 501, an encoder converts an overlapped first residual signal into an analysis signal using Hilbert transform. The analysis signal is defined as shown in Equation 13.

$$res_c(b)=\mathrm{pres}_{tdlp}(b)+jHT\{\mathrm{pres}_{tdlp}(b)\} \quad \text{[Equation 13]}$$

In Equation 13, $\mathrm{pres}_{tdlp}(b)$ denotes an overlapped first residual signal, HT{ } denotes a function of performing the Hilbert transform, and j denotes a variable for representing a complex number. $\mathrm{res}_c(b)$ denotes an analysis signal. The analysis signal indicates an overlapped first residual signal $\mathrm{pres}_{tdlp}(b)$ and a Hilbert-transformed first residual signal $HT\{\mathrm{pres}_{tdlp}(b)\}$.

In operation 502, the encoder converts the analysis signal into a frequency domain. For example, using DFT, the encoder converts the analysis signal into the frequency domain according to Equation 14.

$$res_{c,f}(b)=DFT_{2N}res_c(b)) \quad \text{[Equation 14]}$$

In Equation 14, $\mathrm{res}_{c,f}(b)$ denotes an analysis signal converted into the frequency domain, and $DFT_{2N}\{\ \}$ denotes a function of outputting a result of a conversion performed based on 2N-point DFT. c is a variable indicating a complex number.

In operation 503, the encoder determines a linear predictive coefficient of the frequency domain from the analysis signal converted into the frequency domain using the linear predictive coding. Specifically, the encoder may determine the linear predictive coefficient according to Equations 15 and 16.

$$err_c(k)=res_{c,f}(k)+\Sigma_{p=0}^{P}lpc_{fdlp,c}(p)res_{c,f}(k-p) \quad \text{[Equation 15]}$$

$$err(k)=\mathrm{real}\{res_{c,f}(k)\}+\Sigma_{p=0}^{P}lpc_{fdlp}(p)\cdot\mathrm{real}\{res_{c,f}(k-p)\},0\le k\le N \quad \text{[Equation 16]}$$

In Equations 15 and 16, p denotes a number of linear predictive coefficients, $\mathrm{lpc}_{fdlp}(\ )$ denotes a linear predictive coefficient of the frequency domain, and c is a variable indicating a complex number. Since a value is calculated in a form of the complex number when using Equation 15, the linear predictive coefficient of the frequency domain may be extracted as a value of a real number according to Equation 16. In Equation 16, real{ } denotes a function of outputting a result obtained by extracting a value of a real number from an input value. k denotes a bin index of a frequency bin index and N denotes a maximum range of a frequency bin.

The encoder may reduce an amount of data to be encoded by determining the linear predictive coefficient of the time domain according to Equation 2. However, when encoding an audio signal according to Equation 2, a time envelope may be inaccurately predicted. Thus, the encoder of the present disclosure generates a time envelope using a linear predictive coefficient of the frequency domain and extracts a second residual signal, thereby preventing aliasing occurring in the time domain.

Figure 6:
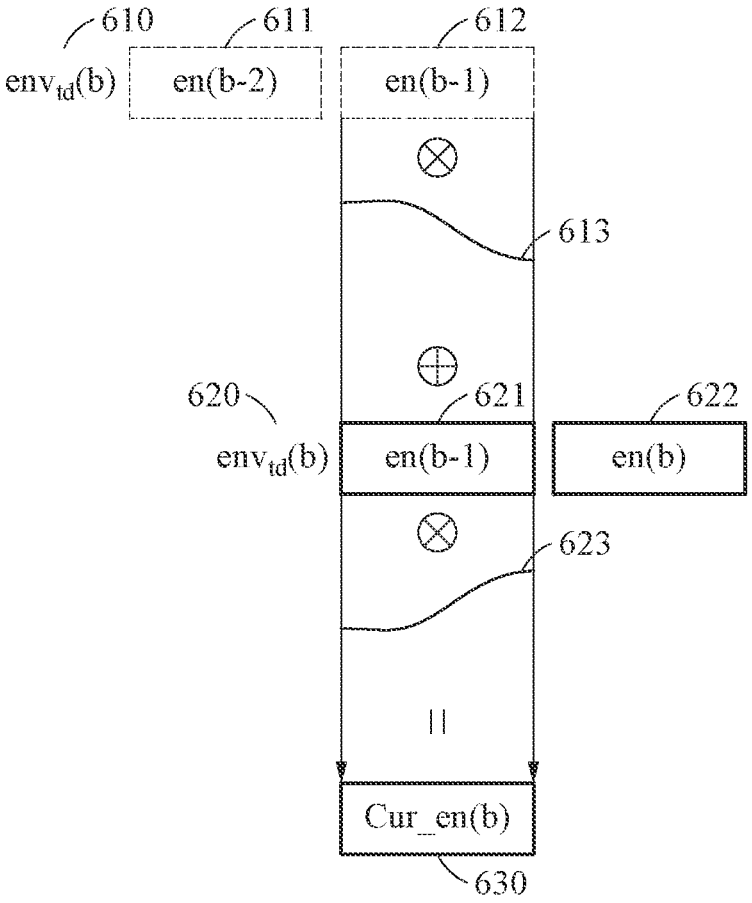
FIG. 6 is a diagram illustrating a process of generating a current envelope according to an example embodiment of the present disclosure.

FIG. 6 is a diagram illustrating a process of generating a current envelope according to an example embodiment of the present disclosure.

In a second residual signal generating process, an encoder extracts a second residual signal of a time domain from an overlapped first residual signal based on a time envelope. First, the encoder generates an interpolated current envelope 630 from time envelopes 610 and 620 using symmetric windowing.

The time envelope 620 is generated based on an original block included in a combined block. When a value 621 of a time envelope 623 corresponding to a (b−1)-th original block and a value 622 of a time envelope corresponding to a b-th original block are given, the encoder may combine a result 613 of symmetric windowing performed on a value of the time envelope corresponding to a specific original block and the value 621 of the time envelope 623 before the symmetric windowing, thereby generating the current envelope 630.

In another example, the encoder moves the time envelope by an interval corresponding to one original block 612 and combines the moved time envelope 610 and the time envelope 620 of before movement, thereby generating a current envelope. The reason why the current envelope is generated is that by smoothing the time envelope, it is possible to complement an unstable processing procedure of a section in which an audio signal radically changes.

Figure 7:
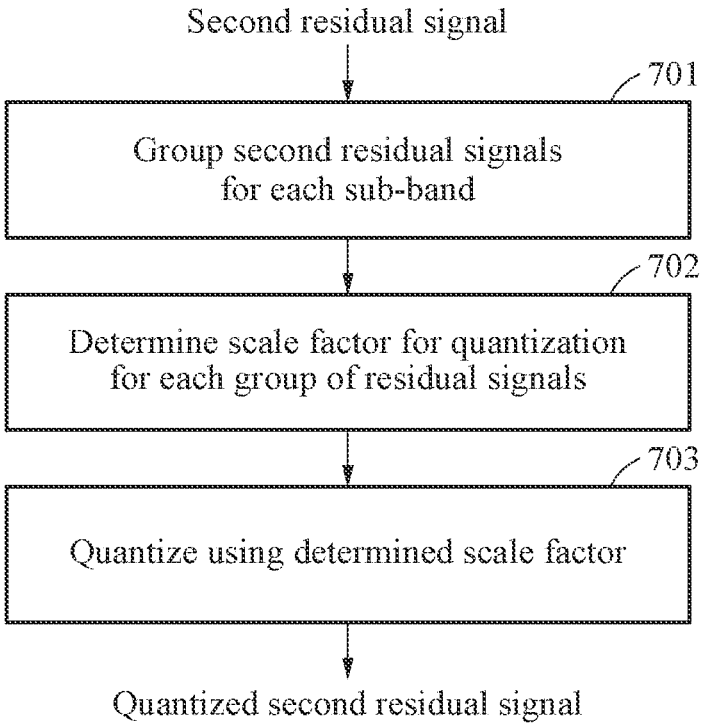
FIG. 7 is a flowchart illustrating a process of quantizing a residual signal using a scale factor according to an example embodiment of the present disclosure.

FIG. 7 is a flowchart illustrating a process of quantizing a residual signal using a scale factor according to an example embodiment of the present disclosure.

In operation 701, the encoder groups second residual signals for each sub-band. In operation 701, the grouping is performed to vary the number of bits used for quantization for each sub-band. In this case, the number of bits to be used for quantization is allocated more as the sub-band is in a lower band, and is allocated less as the sub-band is in a higher band. The number of bits to be used for quantization represents a resolution of quantization.

The second residual signal corresponding to the k-th sub-band may be defined according to Equation 7.

$$res(k)=[res(B(k-1)),res(B(k-1)+1), \ldots ,res(B(k+1)-1)]^T, 0 \le k \le B-1 \quad \text{[Equation 17]}$$

In Equation 17, B denotes a number of sub-bands. k denotes an index of a separated sub-band. B(k) denotes an audio sample corresponding to the k-th sub-band. When an original block includes N audio samples, B(B) is 2/N and B(0) is 0. Accordingly, in a quantization process of the sub-band, res(k) denotes a second residual signal corresponding to the audio sample belonging to the k-th sub-band.

In operation 702, the encoder determines a scale factor for quantization for each group of the second residual signals. For example, the encoder estimates a scale factor for each sub-band. The encoder determines the scale factor to be an intermediate value of the second residual signal or determines the scale factor based on the number of bits available for quantization of the second residual signal.

When determining the scale factor based on the number of bits available for the quantization of the second residual signal, the encoder allocates the number of bits available for the quantization for each sub-band. The number of bits to be used for quantization is allocated more as the sub-band is in a lower band, and is allocated less as the sub-band is in a higher band.

The encoder calculates a total energy of the second residual signal for each sub-band according to Equation 18 and compares the calculated total energy and the number of bits to be used for quantization, thereby determining the scale factor. In this case, to compare the total energy and the number of bits to be used for quantization, the encoder may divide the total energy by a threshold decibel represented based on a unit of, for example, decibels per bit (dB/bit) and compare a result obtained through the dividing to the number of numbers to be used for quantization. The threshold decibel may be, for example, 6 dB/bit.

[Equation 18]

$$\text{energy} = \frac{1}{Ab(k+1)-Ab(k)+1} \sum_{k=Ab(k)}^{k=Ab(k+1)} |res(k)|^2 0 \le k \le K-1$$

In Equation 8, energy refers to a total energy of a residual signal in a specific sub-band. K denotes the number of sub-bands. k denotes one of separated sub-bands. Ab( ) denotes an index corresponding to a boundary between the sub-bands. For example, Ab(0) is 0. The encoder may calculate the total energy by obtaining a sum of absolute values of a residual signal res(k) corresponding to the k-th sub-band. Specifically, the encoder calculates the total energy by dividing the sum of the absolute values of the residual signal res(k) corresponding to the k-th sub-band by a range of the k-th sub-band.

When a result obtained by dividing the total energy by the threshold decibel is greater than the number of bits to be used for quantization, the encoder compares the total energy by twice the threshold decibel and compares a result of the dividing to the number of bits to be used for quantization.

In this example, when the result obtained by dividing the total energy by twice the threshold decibel is less than the number of bits to be used for quantization, the encoder may determine, to be a scale factor, a candidate decibel that allows a result of dividing the total energy by the candidate decibel i) to be less than the number of bits to be used for quantization and ii) to have a smallest difference compared to the number of bits to be used for quantization, among candidate decibels greater than the threshold decibel and less than twice the threshold decibel.

In addition, when the result obtained by dividing the total energy by twice the threshold decibel is greater than the number of bits to be used for quantization, the encoder performs the foregoing process by dividing the total energy by four times the threshold decibel.

Also, when the result obtained by dividing the total energy by the threshold decibel is less than the number of bits to be used for quantization, the encoder divides the total energy by ½ times the threshold decibel and compares a result of the dividing to the number of bits to be used for quantization.

When the result obtained by dividing the total energy by ½ times the threshold decibel is less than the number of bits to be used for quantization, the encoder may determine, to be a scale factor, a candidate decibel that allows a result of dividing the total energy by the candidate decibel i) to be less than the number of bits to be used for quantization and ii) to have a smallest difference compared to the number of bits to be used for quantization, among candidate decibels less than the threshold decibel and greater than ½ times the threshold decibel.

Also, when the result obtained by dividing the total energy by twice the threshold decibel is greater than the number of bits to be used for quantization, the encoder performs the foregoing process by dividing the total energy by ¼ times the threshold decibel.

As an example, when the threshold decibel is 6 dB, and when the number of bits to be used for quantization is greater than the result obtained by dividing the total energy by the threshold decibel, the encoder compares the number of bits to be used for quantization and a result obtained by dividing the total energy by 3 dB. Among candidate decibels greater than 3 dB and less than 6 dB, the encoder determines, to be a scale factor, a candidate decibel that minimizes a difference between the result obtained by dividing the total energy by the candidate decibel and the number of bits to be used for quantization. In this example, the encoder may divide the total energy by at most 0.125 dB and compares a result of the dividing to the number of bits to be used for quantization.

As another example, when the number of bits to be used for quantization is N, decibels representable from the bits to be used for quantization is approximately 6*N dB. The encoder compares the total energy for each sub-band to 6*N dB and determines a scale factor that allows the total energy to be represented by 6*N dB. If N=2 bit, and if the total energy of the sub-band is 20 dB, it is difficult to represent the total energy by 12 dB, which is N*6 dB. Thus, a scale factor that lowers the total energy of the sub-band to reach 12 dB is determined in a binary process.

That is, the encoder may determine, to be a scale factor for each sub-band, a candidate decibel that minimizes a difference between the result obtained by dividing the total energy by the candidate decibel and the number of bits to be used for quantization.

In operation 703, the encoder may quantize the second residual signal using the determined scale factor. Specifically, the encoder may acquire a second residual signal quantized through Equations 19 to 21.

$$\text{abs}(resQ(B(k):B(k+1)))=10\log 10(\text{abs}(res_f[B(k):B(k+1)])^2)-SF(k), 0\le k\le B-1 \quad \text{[Equation 19]}$$

$$\text{angle}(resQ(B(k):B(k+1)))=\text{angle}(res_f[B(k):B(k+1)]), 0\le k\le B-1 \quad \text{[Equation 20]}$$

$$resQ(B(k):B(k+1))=\text{abs}(res_f(B(k):B(k+1)))\exp(j\times \text{angle}(res_f(B(k):B(k+1)))) \quad \text{[Equation 21]}$$

In Equation 19, SF(k) denotes a scale factor determined for the k-th sub-band. B(k):B(k+1) denotes an audio sample of the original block corresponding to the k-th sub-band. resQ denotes a quantized second residual signal. $res_f$ denotes a second residual signal. The other variables and functions are the same as those described in Equations 1 through 20.

The encoder converts the second residual signal into decibels for each sub-band according to Equation 19 and subtracts the scale factor, thereby obtaining an absolute value of the quantized second residual signal for each sub-band.

The encoder may calculate a phase angle of a quantized second residual signal resQ(B(k):B(k+1)) based on a phase angle of a second residual signal $res_f$(B(k):B(k+1)) corresponding to the k-th sub-band according to Equation 20.

The encoder may acquire the quantized second residual signal from the absolute value and the phase angle of the quantized second residual signal according to Equation 21. The encoder may determine a second residual signal by multiplying an output value of an exponential function expo for a phase angle angle(resQ(B(k):B(k+1))) of the quantized second residual signal by an absolute value abs(resQ(B(k):B(k+1))) of the quantized second residual signal. Also, the encoder may obtain an integer value of the quantized second residual signal through an operation method such as rounding up or rounding off.

Figure 8:
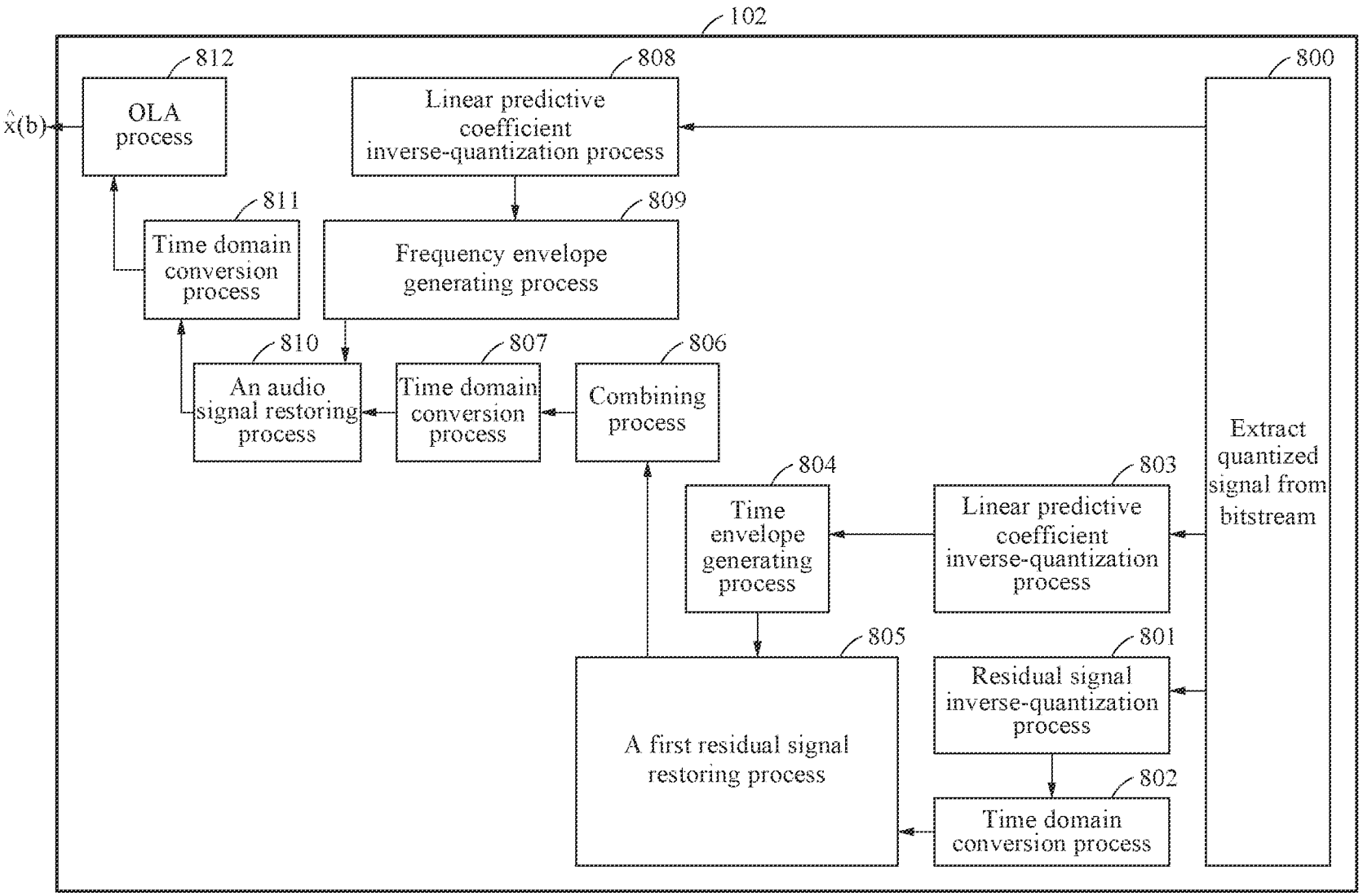
FIG. 8 is a diagram illustrating an operation of a decoder according to an example embodiment of the present disclosure.

FIG. 8 is a diagram illustrating an operation of a decoder according to an example embodiment of the present disclosure.

In an extraction process 800, the decoder 102 extracts a quantized linear predictive coefficient of a time domain, a quantized linear predictive coefficient of a frequency domain, and a quantized second residual signal of the frequency domain from a bitstream received from an encoder.

In addition, the decoder 102 may extract a scale factor from the bitstream received from the encoder. The extraction process 800 may employ a generally used decoding scheme and is not limited by a specific embodiment.

In a residual signal inverse-quantization process 801, the decoder 102 inversely quantizes a second residual signal. The inverse-quantization process is conducted by inversely performing a quantization process. Specifically, the decoder 102 may inversely quantize a quantized residual signal through Equations 22 to 24.

$$\text{abs}(\widehat{res}(B(k):B(k+1)))=10\log 10(\text{abs}(resQ[B(k):B(k+1)])^2)+SF(k), 0\le k\le B-1 \quad \text{[Equation 22]}$$

$$\text{angle}(\widehat{res}(B(k):B(k+1))=\text{angle}(resQ[B(k):B(k+1)]), 0\le k\le B-1 \quad \text{[Equation 23]}$$

$$\widehat{res}(B(k):B(k+1))=\text{abs}(\widehat{res}(B(k):B(k+1)))\exp(j\times \text{angle}(\widehat{res}(B(k):B(k+1)))) \quad \text{[Equation 24]}$$

In Equation 22, $\widehat{res}$ denotes an inverse-quantized second residual signal, and the other variables and functions are the same as those described in Equations 1 through 21. That is, the decoder 102 may calculate an absolute value of the inverse-quantized second residual signal by adding the scale factor to a conversion result of the inverse-quantized second residual signal for each sub-band.

In addition, through Equation 23, the decoder 102 may acquire a phase angle of the second residual signal using a phase angle of the quantized second residual signal for each sub-band. The decoder 102 may restore the inverse-quantized second residual signal from the absolute value and the phase angle of the inverse-quantized second residual signal according to Equation 24.

In a time domain conversion process 802, the decoder 102 converts the inverse-quantized second residual signal into the time domain. The decoder 102 may convert the second residual signal into the time domain using IDFT or IMDCT. However, a time domain conversion method is not limited to the aforementioned methods, and various methods may apply.

The decoder 102 generates the time envelope from a quantized linear predictive coefficient of the time domain through a linear predictive coefficient inverse-quantization process 803 and a time envelope generating process 804.

Specifically, in the linear predictive coefficient inverse-quantization process 803, the decoder 102 may inversely quantize the quantized linear predictive coefficient of the frequency domain, thereby restoring the linear predictive coefficient of the frequency domain. The inverse-quantization of the linear predictive coefficient of the frequency domain may be performed in an inversed manner of the quantization of the linear predictive coefficient of the frequency domain and may employ a commonly used quantization method.

In the time envelope generating process 804, the decoder 102 generates a time envelope using the inverse-quantized linear predictive coefficient of the frequency domain. Specifically, the decoder 102 calculates an absolute value of the linear predictive coefficient of the frequency domain and determines a time envelope for each sub-band. The decoder 102 determines a value for each sub-band of the time envelope using Equation 25, thereby restoring the time envelope.

$$env_{td}(k)=\frac{1}{A(k+1)-A(k)+1}\times 10\times \log 10\left[\sum_{kk=A(k)}^{kk=A(k+1)}\text{abs}(s_lpc_{td}(kk))^2\right] 0\le k\le K-1 \quad \text{[Equation 25]}$$

In Equation 25, $\text{env}_{td}$(k) denotes a value of the time envelope corresponding to the k-th sub-band. AO denotes an index of an audio sample corresponding to a boundary between sub-bands. For example, A(k) denotes an audio sample corresponding to the k-th sub-band, and A(k+1)-A(k)+1 denotes a number of audio samples corresponding to the k-th sub-band. kk denotes an index of a sub-band belonging to a section of the k-th sub-band. abs( ) is a function of calculating an absolute function. K denotes a number of sub-bands.

The decoder 102 may determine the time envelope for each sub-band by calculating an average of absolute values of the linear predictive coefficient of the time domain for each sub-band. $\text{s_lpc}_{td}$( ) is a linear predictive coefficient obtained through smoothing processing of the linear predictive coefficient of the time domain. For example, the smoothing processing may be performed according to Equation 5. The smoothing processing may be performed by linearly interpolating i) a linear predictive coefficient of the time domain corresponding to a current original block and ii) a linear predictive coefficient of the time domain corresponding to a previous original block.

In the first residual signal generating process 805, the decoder 102 may restore the first residual signal from the second residual signal using the generated time envelope. Specifically, the decoder 102 may restore the first residual signal from the second residual signal through Equations 26 through 28.

$$\mathrm{abs}(\widehat{res_{tdlp}}(b))=10\log 10(\mathrm{abs}(\widehat{res}(b))^2)+cur_en(b) \quad \text{[Equation 26]}$$

$$\mathrm{angle}(\widehat{res_{tdlp}}(b))=\mathrm{angle}(\widehat{res}(b)) \quad \text{[Equation 27]}$$

$$\widehat{res_{tdlp}}(b)=\mathrm{abs}(\widehat{res_{tdlp}}(b))\exp(j\times \mathrm{angle}(\widehat{res_{tdlp}}(b))) \quad \text{[Equation 28]}$$

In Equation 26, b denotes an index of the current original block. cur_en(b) denotes a current envelope corresponding to the current original block. $\widehat{res}$(b) denotes a second residual signal corresponding to the b-th original block in the second residual signal. $\widehat{res_{tdlp}}$ (b) denotes a first residual signal corresponding to the b-th original block in the first residual signal. The decoder 102 determines an absolute value of the second residual signal. The decoder 102 may calculate a sum of the determined absolute value and the current envelope, thereby obtaining an absolute value of the restored first residual signal of the time domain.

In Equation 27, the decoder 102 may calculate a phase angle of the first residual signal from the phase angle of the second residual signal. The decoder 102 may determine the first residual signal from the absolute value of the first residual signal and the phase angle of the first residual signal calculated according to Equation 28.

Specifically, the decoder 102 may determine the first residual signal by multiplying an output value of an exponential function exp( ) for the phase angle of the first residual signal by the absolute value of the first residual signal. j is a variable for representing a complex number.

Also, in a combining process 806, the decoder 102 determines a first residual signal $\widehat{pres_{tdlp}}$(b) based on a first residual signal [ $\widehat{pres_{tdlp}}$(b−1), $\widehat{pres_{tdlp}}$(b)]$^T$ restored by combining a second residual signal $\widehat{pres_{tdlp}}$(b−1) corresponding to the (b−1)-th original block and a first residual signal $\widehat{pres_{tdlp}}$(b) corresponding to the b-th original block as shown in Equation 29. In this instance, the first residual signal is in the frequency domain.

$$\widehat{pres_{tdlp}}(b)=[\widehat{pres_{tdlp}}(b-1), \widehat{pres_{tdlp}}(b)]^T \quad \text{[Equation 29]}$$

In a time domain conversion process 807, the decoder 102 converts the first residual signal into the time domain. For example, the decoder 102 may use the IMDCT to convert the first residual signal into the time domain. The converted first residual signal $\widehat{pres_{tdlp,f}}$ (b) of the time domain is determined by Equation 30. The converted first residual signal $\widehat{pres_{tdlp,f}}$ (b) of the time domain corresponds to the b-th combined block.

$$\widehat{pres_{tdlp,f}}(b)=IMDCT\{\widehat{pres_{tdlp}}(b)\} \quad \text{[Equation 30]}$$

In an audio signal restoring process 810, the decoder 102 restores combined blocks from the first residual signal using the frequency envelope. The frequency envelope is generated through a linear predictive coefficient inverse-quantization process 808 and a frequency envelope generating process 809.

Specifically, in the linear predictive coefficient inverse-quantization process 808, the decoder 102 inversely quantizes the linear predictive coefficient of the time domain extracted from the bitstream. The inverse-quantization process may be performed in an inversed manner of the quantization process and may employ a commonly used quantization process.

In the frequency envelope generating process 809, the decoder 102 generates a frequency envelope using the linear predictive coefficient of the time domain.

In the audio signal restoring process 810, the decoder 102 extracts the combined blocks of the audio signal from the restored first residual signal based on the frequency envelope.

Also, the decoder 102 extracts a combined block of an audio signal from the first residual signal using the frequency envelope according to Equations 31 through 33.

$$\mathrm{abs}(\hat{X}_{tda,f}(A(k):A(k+1)))=10\log 10(\mathrm{abs}(\widehat{pres_{tdlp,f}}[A(k):A(k+1)])^2)+env_{fd}(k), 0\le k\le K-1 \quad \text{[Equation 31]}$$

$$\mathrm{angle}(\hat{X}_{tda,f}(A(k):A(k+1)))=\mathrm{angle}(\widehat{pres_{tdlp,f}}[A(k):A(k+1)]), 0\le k\le K-1 \quad \text{[Equation 32]}$$

$$\hat{X}_{tda,f}(A(k):A(k+1))=\mathrm{abs}(\hat{X}_{tda,f}(A(k):A(k+1)))\exp(j\times \mathrm{angle}(\hat{X}_{tda,f}(A(k):A(k+1)))) \quad \text{[Equation 33]}$$

In Equations 31 through 33, $\hat{X}_{tda,f}$ denotes a restored combined block of the frequency domain. K denotes a number of sub-bands. $env_{fd}$(k) denotes a value corresponding to the k-th sub-band in the frequency envelope. The other variables and functions are the same as those described in Equations 1 through 33.

For example, the decoder 102 may acquire an absolute value abs ($\hat{X}_{tda,f}$(A(k):A(k+1))) of a combined block by adding a value $env_{fd}$(k) of the frequency envelope to a result 10 log 10 (abs( $\widehat{pres_{tdlp,f}}$ [A(k):A(k+1)])$^2$) obtained by converting an absolute value abs( $\widehat{pres_{tdlp,f}}$ [A(k):A(k+1)]) of the first residual signal corresponding to the k-th sub-band. In addition, through Equation 32, the decoder 102 may calculate a phase angle of the combined block based on a phase angle angle( $\widehat{pres_{tdlp,f}}$ [A(k):A(k+1)]) of the first residual signal.

Also, the decoder 102 may acquire a combined block of the audio signal from the absolute value and the phase angle of the combined value according to Equation 33. The decoder 102 may acquire a combined block for each sub-band by multiplying an output value of an exponential function exp( ) for a phase angle angle($\hat{X}_{tda,f}$(A(k):A(k+1))) of the audio signal by an absolute value abs ($\hat{X}_{tda,f}$(A(k):A(k+1))) of the quantized residual value.

In a time domain conversion process 811, the decoder 102 converts the acquired combined block into the time domain to decode the audio signal. For example, the decoder 102 may convert the restored combined block into the time domain using IMDCT or IDFT according to Equation 34.

$$\hat{X}_{tda}(b)=IMDCT\{\hat{X}_{tda,f}(b)\} \quad \text{[Equation 34]}$$

In Equation 34. $\hat{X}_{tda}$(b) is a b-th combined block converted into the time domain and $\hat{X}_{tda,f}$(b) is a b-th combined block of the frequency domain. In an overlap-add (OLA) process 812, the decoder 102 may acquire a final combined block in which time domain aliasing (TDA) is eliminated by using an OLA operation for the combined block. The b-th combined block includes a restored original block (b).

Figure 9:
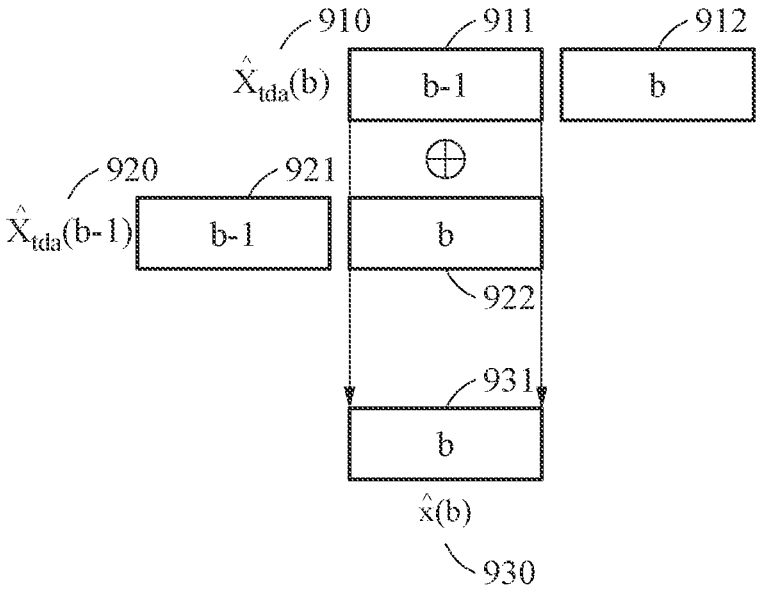
FIG. 9 is a diagram illustrating a process of combining restored audio signals according to an example embodiment of the present disclosure.

FIG. 9 is a diagram illustrating a process of combining restored audio signals according to an example embodiment of the present disclosure.

FIG. 9 is a diagram illustrating the OLA process 812 of FIG. 8 in detail. $\hat{X}_{tda}(b)$ of FIG. 9 is a b-th combined block 910 converted into a time domain and $\hat{X}_{tda}(b-1)$ is a (b−1)-th combined block 920 combined into the time domain.

The b-th combined block 910 includes a b-th original block 912 and a (b-1)-th original block 911. The b-th combined block 910 includes a (b-2)-th original block 921 and a (b-1)-th original block 922. In FIG. 9, the original blocks 911, 912, 921, and 922 included in the combined blocks 910 and 920 are indicated by a current original block b and a previous original block b-1.

A decoder may combine the b-th combined block and the (b−1)-th combined block, thereby generating a b-th original block 930 in which TDA is eliminated.

Figure 10:
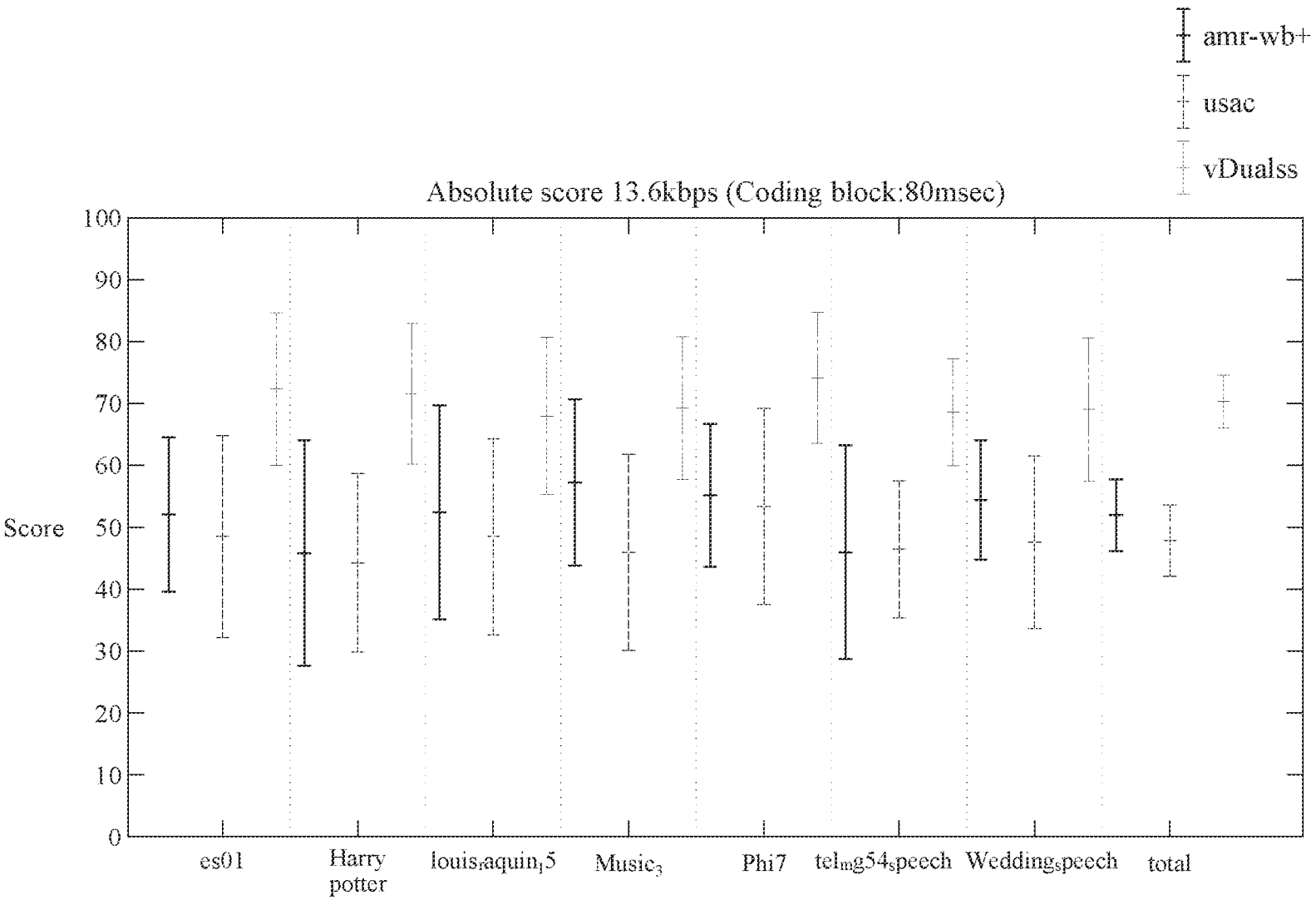
FIG. 10 is a graph that shows an experiment result according to an example embodiment of the present disclosure.

FIG. 10 is a graph that shows an experiment result according to an example embodiment of the present disclosure.

FIG. 10 is a graph in which absolute scores of a method of the present disclosure and a related art are compared in terms of a sound quality of a restored audio signal. In FIG. 10, vDualss denotes encoding and decoding results obtained according to the present disclosure, and arm-wb+ and usac denote results obtained by applying typical audio coding techniques. FIG. 10 shows results of experiments conducted on a plurality of different items (e.g., es01, Harry Potter, etc.).

The components described in the example embodiments may be implemented by hardware components including, for example, at least one digital signal processor (DSP), a processor, a controller, an application-specific integrated circuit (ASIC), a programmable logic element, such as a field programmable gate array (FPGA), other electronic devices, or combinations thereof. At least some of the functions or the processes described in the example embodiments may be implemented by software, and the software may be recorded on a recording medium. The components, the functions, and the processes described in the example embodiments may be implemented by a combination of hardware and software.

The optical access network system for slice connection or a slice connection network of an optical access network according to the present disclosure may be embodied as a program that is executable by a computer and may be implemented as various recording media such as a magnetic storage medium, an optical reading medium, and a digital storage medium.

Various techniques described herein may be implemented as digital electronic circuitry, or as computer hardware, firmware, software, or combinations thereof. The techniques may be implemented as a computer program product, i.e., a computer program tangibly embodied in an information carrier, e.g., in a machine-readable storage device (for example, a computer-readable medium) or in a propagated signal for processing by, or to control an operation of a data processing apparatus, e.g., a programmable processor, a computer, or multiple computers. A computer program(s) may be written in any form of a programming language, including compiled or interpreted languages and may be deployed in any form including a stand-alone program or a module, a component, a subroutine, or other units suitable for use in a computing environment. A computer program may be deployed to be executed on one computer or on multiple computers at one site or distributed across multiple sites and interconnected by a communication network.

Processors suitable for execution of a computer program include, by way of example, both general and special purpose microprocessors, and any one or more processors of any kind of digital computer. Generally, a processor will receive instructions and data from a read-only memory or a random access memory or both. Elements of a computer may include at least one processor to execute instructions and one or more memory devices to store instructions and data. Generally, a computer will also include or be coupled to receive data from, transfer data to, or perform both on one or more mass storage devices to store data. e.g., magnetic, magneto-optical disks, or optical disks. Examples of information carriers suitable for embodying computer program instructions and data include semiconductor memory devices, for example, magnetic media such as a hard disk, a floppy disk, and a magnetic tape, optical media such as a compact disk read only memory (CD-ROM), a digital video disk (DVD), etc. and magneto-optical media such as a floptical disk, and a read only memory (ROM), a random access memory (RAM), a flash memory, an erasable programmable ROM (EPROM), and an electrically erasable programmable ROM (EEPROM). A processor and a memory may be supplemented by, or integrated into, a special purpose logic circuit.

Also, non-transitory computer-readable media may be any available media that may be accessed by a computer and may include both computer storage media and transmission media.

The present specification includes details of a number of specific implements, but it should be understood that the details do not limit any invention or what is claimable in the specification but rather describe features of the specific example embodiment. Features described in the specification in the context of individual example embodiments may be implemented as a combination in a single example embodiment. In contrast, various features described in the specification in the context of a single example embodiment may be implemented in multiple example embodiments individually or in an appropriate sub-combination. Furthermore, the features may operate in a specific combination and may be initially described as claimed in the combination, but one or more features may be excluded from the claimed combination in some cases, and the claimed combination may be changed into a sub-combination or a modification of a sub-combination.

Similarly, even though operations are described in a specific order on the drawings, it should not be understood as the operations needing to be performed in the specific order or in sequence to obtain desired results or as all the operations needing to be performed. In a specific case, multitasking and parallel processing may be advantageous. In addition, it should not be understood as requiring a separation of various apparatus components in the above-described example embodiments in all example embodiments, and it should be understood that the above-described program components and apparatuses may be incorporated into a single software product or may be packaged in multiple software products.

It should be understood that the example embodiments disclosed herein are merely illustrative and are not intended to limit the scope of the invention. It will be apparent to one of ordinary skill in the art that various modifications of the example embodiments may be made without departing from the spirit and scope of the claims and their equivalents.

What is claimed is:

1. A method of encoding an audio signal in of an encoding device, the method comprising:

identifying an audio signal of a time domain;

extracting a first residual signal of a frequency domain represented by a complex number from the audio signal of a time domain using linear predictive coding of a time domain;

converting the first residual signal into a time domain;

generating a second residual signal of a time domain from the converted first residual signal using linear predictive coding of a frequency domain;

quantizing a plurality of the second residual signals;

encoding a linear predictive coefficient of a time domain, linear predictive coefficient of a frequency domain, and the second residual signal into a bitstream; and outputting the bitstream to a decoding device, wherein the quantizing of the plurality of second residual signals comprises:

grouping the plurality of second residual signals for each sub-band;

determining a scale factor for quantization for each group of the plurality of second residual signals; and quantizing the plurality of second residual signals using the scale factor.

2. The method of claim 1, wherein the identifying an audio signal of a time domain comprises:

identifying an audio signal of a time domain in units of a block, further comprising:

generating a combined block by combining i) a current original block of the audio signal and ii) a previous original block chronologically adjacent to the current original block.

3. The method of claim 1, further comprising:

quantizing a linear predictive coefficient of a time domain extracted from the combined block of the audio signal; and generating a frequency envelope by inversely quantizing the linear predictive coefficient of the time domain, wherein the extracting of the first residual signal generates a first residual signal from the combined block converted into a frequency domain based on the frequency envelope, and the encoding into the bitstream additionally encodes the quantized linear predictive coefficient of the time domain into a bitstream.

4. The method of claim 1, further comprising:

overlapping first residual signals chronologically adjacent to each other among the first residual signals converted into a time domain;

quantizing a linear predictive coefficient of a frequency domain extracted from the overlapped first residual signal using linear predictive coding of a frequency domain;

generating a time envelope by inversely quantizing the linear predictive coefficient of the frequency domain; and extracting a second residual signal of a time domain from the overlapped first residual signal based on the time envelope, wherein the encoding into the bitstream additionally encodes the quantized linear predictive coefficient of the frequency domain into a bitstream.

5. The method of claim 4, wherein the quantizing of the linear predictive coefficient of the frequency domain comprises:

performing Hilbert-transformation on the overlapped first residual signal;

converting the Hilbert-transformed first residual signal and the overlapped residual signal into a frequency domain;

extracting a linear predictive coefficient of a frequency domain corresponding to the Hilbert-transformed first residual signal and the overlapped first residual signal using linear predictive coding; and quantizing the linear predictive coefficient of the frequency domain.

6. The method of claim 4, wherein the extracting of the second residual signal comprises:

generating a current envelope interpolated from a time envelope using symmetric windowing; and extracting a second residual signal of a time domain from the overlapped first residual signal based on the current envelope.

7. The method of claim 2, wherein the first residual signal corresponds to two original blocks chronologically adjacent to each other, and the overlapping of the first residual signal overlaps two first residual signals corresponding to an original block belonging to a predetermined time among first residual signals adjacent chronologically.

8. The method of claim 3, wherein the generating of the frequency envelope comprises:

converting inversely quantized linear predictive coefficients of the time domain into a frequency domain;

grouping the converted linear predictive coefficients of the time domain for each sub-band; and generating a frequency envelope corresponding to the combined block by calculating energy of the grouped linear predictive coefficients of the time domain.

9. The method of claim 1, wherein the determining of the scale factor determines the scale factor based on an intermediate value of a frequency envelope corresponding to the second residual signal or determines the scale factor based on a number of bits available for quantization of the second residual signal.

10. A method of decoding an audio signal of a decoding device, the method comprising:

receiving a bitstream from an encoding device;

extracting a linear predictive coefficient of a time domain, a linear predictive coefficient of a frequency domain, and a second residual signal of a frequency domain from the bitstream;

converting the second residual signal into a time domain;

converting the second residual signal into a time domain by inversely quantizing a plurality of the second residual signals;

generating a first residual signal of a frequency domain from the converted second residual signal using the linear predictive coefficient of the time domain;

converting the first residual signal into a time domain;

restoring an audio signal of a frequency domain from the converted first residual signal using the linear predictive coefficient of the frequency domain; and converting the audio signal in the frequency domain into a time domain, wherein the inversely quantizing of the plurality of second residual signals is performed by inversely performing quantizing of the plurality of second residual signals, and wherein the quantizing of the plurality of second residual signals comprises:

grouping the plurality of second residual signals for each sub-band;

determining a scale factor for quantization for each group of the plurality of second residual signals; and quantizing the plurality of second residual signals using the scale factor.

11. The method of claim 10, wherein the restored audio signal includes a combined block, further comprising:

generating a restored block by overlapping original blocks corresponding to a same point in time among original blocks included in the restored combined blocks adjacent chronologically.

12. The method of claim 10, wherein the generating of the first residual signal comprises:

generating a current envelope interpolated from a time envelope using symmetric windowing;

and generating the first residual signal from the converted second residual signal using the current envelope.

13. An encoding device for performing a method of encoding an audio signal, the encoding device comprising:

a processor, wherein the processor is configured to identify an audio signal of a time domain, extract a first residual signal of a frequency domain represented by a complex number from the audio signal of a time domain using linear predictive coding of a time domain, convert the first residual signal into a time domain, generate a second residual signal of a time domain from the converted first residual signal using linear predictive coding of a frequency domain, quantize a plurality of the second residual signals, and encode a linear predictive coefficient of a time domain, linear predictive coefficient of a frequency domain, and the second residual signal into a bitstream, and output the bitstream to a decoding device, wherein the quantizing of the plurality of second residual signals comprises:

grouping the plurality of second residual signals for each sub-band;

determining a scale factor for quantization for each group of the plurality of second residual signals; and quantizing the plurality of second residual signals using the scale factor.

14. The encoding device of claim 13, wherein the processor is configured to identify an audio signal of a time domain in units of a block, generate a combined block by combining i) a current original block of the audio signal and ii) a previous original block chronologically adjacent to the current original block.

15. The encoding device of claim 13, wherein the processor is configured to quantize a linear predictive coefficient of a time domain extracted from the combined block of the audio signal, generate a frequency envelope by inversely quantizing the linear predictive coefficient of the time domain, generate a first residual signal from the combined block converted into a frequency domain based on the frequency envelope, and additionally encode the quantized linear predictive coefficient of the time domain into a bitstream.

* * * * *